US005806589A

United States Patent [19]

Lang

[11] Patent Number: 5,806,589

[45] Date of Patent: Sep. 15, 1998

[54] APPARATUS FOR STABBING AND THREADING A DRILL PIPE SAFETY VALVE

[76] Inventor: Duane Lang, P.O. Box 4142, Tyler, Tex. 75712

[21] Appl. No.: 650,433

[22] Filed: May 20, 1996

[51] Int. Cl.[6] ..... E21B 19/16

[52] U.S. Cl. ..... 166/77.53; 166/85.5

[58] Field of Search ..... 166/77.51, 77.53, 166/85.1, 85.4, 85.5

[56] References Cited

U.S. PATENT DOCUMENTS

| | | | |
|---|---|---|---|
| 4,423,774 | 1/1984 | Mefford | 166/77.51 |
| 4,442,892 | 4/1984 | Delesandri | 166/85.1 |
| 4,846,271 | 7/1989 | Delesandri | 166/78.1 |
| 5,092,399 | 3/1992 | Lang | 166/77.53 |

*Primary Examiner*—William P. Neuder

*Attorney, Agent, or Firm*—Arnold, White & Durkee

[57] ABSTRACT

An apparatus 10 for automatically stabbing and threading a safety valve 34 into a well pipe 14 to prevent upward flow comprising both automatic and manual modes of operation. The apparatus 10 includes a body 38 that is slidably mounted on an upstanding frame to provide vertical movement of a safety valve 34 carried by a pair of support brackets 94, 96 connected to the body 38. A hydraulic motor 102 and gear train 100 provide rotational movement of the safety valve 34 to thread the safety valve into a well pipe 14 as the body 14 moves the safety valve 14 downward into the well pipe 14. A clamp assembly 12 is connected to a lower portion of the frame and is used to connect the apparatus 10 to the upper end portion of the well pipe. The clamp assembly 12 is connected through an elevator 37 to a hydraulic cylinder 40 to provide horizontal movement of the safety valve 34, and permit horizontal alignment of the well pipe 14 and safety valve 34.

20 Claims, 3 Drawing Sheets

18
22
20
24
66
86
74
10
78
102
100
80
99
88
104
103
94
105
82
69
84
60
34
182
38
96
90
16
68
42
170
180
40
43
36
37
12
14

APPARATUS FOR STABBING AND THREADING A DRILL PIPE SAFETY VALVE

BACKGROUND OF THE INVENTION

1. Field of the Invention

The present invention relates to drill pipe safety valves used for capping oil field drill pipe when a blowout occurs through the pipe, and, more particularly, to a hydraulically actuated apparatus for automatically positioning the safety valve over the drill pipe and threading the safety valve into the drill pipe in both automatic and manual modes of operation.

2. Description of the Related Art

During the drilling of an oil well, the drill bit occasionally penetrates an earth formation that has an unexpectedly high pressure. When the pressure is sufficiently high, the hydrostatic head of drill mud standing in the well is not sufficient to prevent formation fluids from entering the bore hole and traveling upward toward the surface. If such flow is not controlled quickly, a "blowout" of the well occurs and creates very serious safety hazards for personnel working on and around the drilling rig. Further, resulting fire can cause tremendous damage to the drilling equipment.

At a first indication of possible blowout conditions, blowout preventers can be closed around the drill pipe to seal off the annulus. If a kelly by which the drill pipe is driven happens to be attached to the upper end of the string of drill pipe at the time of the potential blowout, then a valve may be present in the system which can be closed to shut off upward flow through the drill pipe itself. However, should upward flow begin while the kelly is not connected to the drill pipe, for example while a threaded connection between pipe sections is being made, a very hazardous situation is presented.

U.S. Pat. No. 4,026,354, issued May 31, 1977, shows a somewhat massive device that is lowered over the open end of the pipe by a crane or a boom and operated by a long drive shaft that extends through a kill line to make a connection with the pipe, and enable a shut-off valve to be closed. Due to its massive nature, this device cannot be positioned and put into operation as quickly as would obviously be desirable under the circumstances.

U.S. Pat. No. 3,625,282, issued Dec. 7, 1971, shows a device having a clamp that mates only with a special type of groove arrangement on the upper end of the casing. The clamp has bolt holes that can be aligned with matching holes on the lower flange of a spool where a master valve is mounted. The clamp and spool have an offset hinge bolt to enable the spool to be pivoted into position. However, this apparatus requires the construction of numerous bolts before complete attachment can be accomplished. This is, of course, time-consuming and, thus, potentially dangerous. Further, the clamp assembly is designed for attachment only to a specific type of machined end fitting.

U.S. Pat. No. 4,442,892, issued Apr. 17, 1984, shows an apparatus for stabbing and threading a safety valve into a well pipe. The apparatus includes a tubular canister rotatably mounted on a carriage assembly that is slidably mounted on an upstanding frame. The lower end of the frame has a swivel mounting to a bracket that is attached to the side of an elevator-type clamp by which the apparatus is clamped onto the upper end portion of the pipe. After the apparatus is clamped onto the pipe, the operator manually operates a gear drive so as to swivel the apparatus in position over the pipe. With the canister pivoted into position over the pipe, the operator manually controls a second gear drive to cause the canister to be rotated and simultaneously lowered toward the pipe whereby a safety valve mounted inside the canister is automatically threaded into the upper end of the pipe and can be closed to shut off upward flow. While the apparatus is generally satisfactory in operation, the gear drives are relatively complex mechanical devices and, therefore, expensive to manufacture and difficult to assemble.

U.S. Pat. No. 5,092,399, issued Mar. 3, 1992, shows an apparatus for stabbing and threading a safety valve into a well pipe. The apparatus, however, is complex in mechanical and hydraulic design, making it unnecessarily difficult to design and build, costly in construction, and unnecessarily large and cumbersome.

The present invention is directed to overcoming one or more of the problems set forth above.

SUMMARY OF THE INVENTION

In one aspect of the present invention, an apparatus is provided for threading a valve into a well pipe for shutting off upward flow therethrough. The apparatus comprises means for attaching the apparatus to the well pipe, means for moving the valve into general alignment with a longitudinal axis of the well pipe, primary and secondary drive means for rotating and vertical displacing the valve, and a controller for switching between the primary and secondary drive means.

In another aspect of the present invention, an apparatus is provided for threading a valve into a well pipe for shutting off upward flow therethrough. The apparatus includes means for attaching the apparatus to the well pipe, and means for moving the valve into general alignment with a longitudinal axis of the well pipe. A primary drive means rotates and vertically displaces the valve. The primary drive means has forward and reverse modes of operation, and means is provided for detecting the primary drive means being in the forward mode of operation and preventing reverse operation in response thereto.

BRIEF DESCRIPTION OF THE DRAWINGS

Other objects and advantages of the invention will become apparent upon reading the following detailed description and upon reference to the drawings in which.

Figure 1:
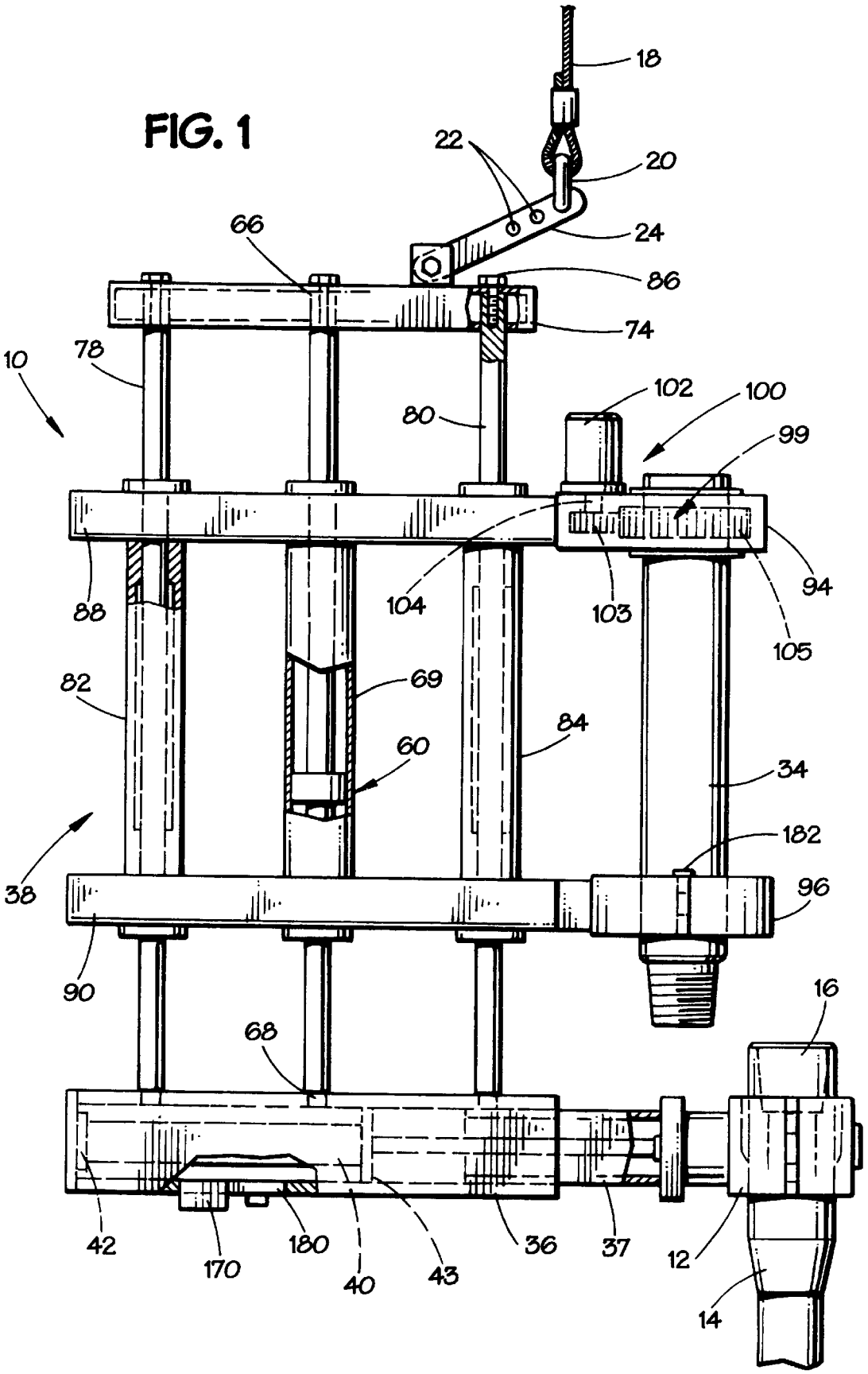
FIG. 1 is a side view of the mechanical portion of one embodiment of a safety valve stabbing apparatus.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Referring to FIG. 1, an apparatus 10 constructed in accordance with the principles of the present invention is shown as including a clamp assembly 12 that is arranged to be positioned around the upper end portion of a joint of drill pipe 14 below an internally threaded box end 16 thereof. The drill pipe 14 is suspended by slips (not shown) in a rotary table (not shown) on the floor of a derrick (not shown).

The positioning of the apparatus 10 with respect to the drill pipe 14 is shown to be accomplished. In a preferred embodiment, by a cable 18 extending between the apparatus 10 and a counterweight (not shown). Preferably, the cable 18 attaches to the apparatus 10 through a U-shaped coupling 20 that passes through a selected one of a plurality of bore holes 22 in a cantilevered arm 24. Thus, the operator positions the U-shaped coupling 20 in the bore hole 22 that is most closely aligned with the center of gravity of the apparatus 10 so that the apparatus 10 hangs from the cable 18 in a generally upright manner. The combination of the counterweight and the upright positioning of the apparatus 10 allows a single operator to easily maneuver the apparatus 10 and position the clamp 12 around the drill pipe 14.

Once the operator has maneuvered the apparatus 10 near the drill pipe 14, he must only move the clamp assembly 12 into contact with the drill pipe 14 so that it automatically engages the drill pipe 14. The clamp assembly 12 automatically operates to locate the apparatus 10 so that a safety valve 34 carried by the apparatus 10 is positioned relative to the drill pipe 14 and can be automatically moved into position directly over the drill pipe 14 and lowered and rotated to threadably engage the threaded box end 16. The clamp assembly 12 is connected to a lower frame 36, which slidably retains an elevator 37 arranged to move horizontally within the lower frame 36. The clamp assembly 12 is preferably of the type described in U.S. Pat. No. 4,442,892; however, as an alternative embodiment, the clamp assembly 12 can also take the form of that disclosed in U.S. Pat. No. 5,092,399.

An upper frame 74 is connected to the lower frame 36 via a pair of support rods 78, 80. The frames 36, 74 and support rods 78, 80 form a slide on which a body 38, which carries the safety valve 34, is arranged to move vertically. Thus, it should be appreciated that when the operator first "stabs" the apparatus 10 onto the drill pipe 14, the elevator 37 is fully withdrawn so that the safety valve 34 is not directly above the drill pipe 14. In this manner, fluid flowing from the drill pipe 14 is not sprayed into the operator's field of vision by contact with the safety valve 34 while the operator is attempting to stab the apparatus 10 onto the drill pipe 14. However, once the apparatus 10 is successfully attached to the drill pipe 14, then the elevator 37 moves the body 38 toward the drill pipe 14 until the safety valve 34 aligns with the threaded box end 16.

Movement of the elevator 37 is effected by a hydraulic cylinder 40. The hydraulic cylinder 40 is connected at its first end portion 42 to an end portion 43 of the lower frame 36, and at its second end portion 44 to the elevator 37. Thus, movement of the hydraulic cylinder 40 produces transverse movement of the elevator 37 and body 38 perpendicularly toward and away from the drill pipe 14. During this movement, the elevator 37 telescopes within the lower frame 36.

The body 38 is similarly moveable in the vertical direction by a hydraulic cylinder 60. The hydraulic cylinder 60 is connected at each end 66, 68 to the upper and lower frame 38, 36, and includes a hydraulic cylinder body 69 connected to the body 38. Thus, movement of the hydraulic cylinder body 69 produces vertical movement of the body 38 axially toward and away from the drill pipe 14.

The support rods 78, 80 are each fixed to the lower and upper frames 36, 74 by, for example, a bolt 86 passing through the frame 74 and into a threaded longitudinal bore (not shown) in the support rod 80. Each of the support rods 78, 80 passes through corresponding bushings 82, 84 extending vertically through the body 38. Bushings 82, 84 are coupled to a top and bottom plate 88, 90 of the body 38 by, for example, press fitting, welding, etc. These bushings 82, 84 provide a relatively close fit between the body 38 and support rods 78, 80 so that the body 38 accurately moves up and down with the hydraulic cylinder 60 with minimal binding.

Vertical movement of the body 38 is associated with like movement of the safety valve 34 so as to move the valve 34 into contact with the threaded box end 16. It should be appreciated that to mate the valve 34 with the threaded box end 16 it is preferred that the safety valve 34, in addition to being moved vertically, also be rotated. Thus, while the safety valve 34 is carried vertically by the body 38 it must also include means for imparting rotation thereto.

A pair of substantially similar upper and lower support brackets 94, 96 extend horizontally from the top and bottom plates 88, 90 of the body 38, respectively. A drive mechanism 100 coupled to or constructed within the upper support bracket 94 rotates the safety valve 34. The drive mechanism 100 is essentially a hydraulic motor 102, which takes the form of either a conventional, fixed-displacement hydraulic motor connected to a gear train 99 within the upper support bracket 94, or a hydraulic motor constructed as a part of the upper support bracket 94.

The gear train 99 consists of a pinion gear 103 coupled to an output shaft 104 of the motor 102. The pinion gear 102 engages with and rotates a ring gear 105 with rotation of the motor 102. The ring gear 105 is coupled with an internal hexagonal sleeve (not shown) that mates with and drives the safety valve 34. Support and retention of the ring gear 105 within the support bracket 94 is accomplished in a conventional manner using suitable bearings and retainers, as will be readily understood by a mechanical engineer of conventional skill in the art. Accordingly, further details of the support and retention will not be provided herein so as not to detract from the description of the invention.

In an alternative embodiment of the drive mechanism 100, the hydraulic motor 102 is constructed within the upper support bracket 94. That is, the hexagonal sleeve is coupled with a circular rotor (not shown), positioned within an offset circular chamber (not shown). As in a conventional vane-type hydraulic motor, a series of spring loaded vanes (not shown) extend radially from the rotor and engage the interior wall of the offset chamber. Thus, fluid under pressure delivered into one side of the offset chamber reacts against the vanes to urge the rotor and hexagonal sleeve to rotate.

Figure 2:
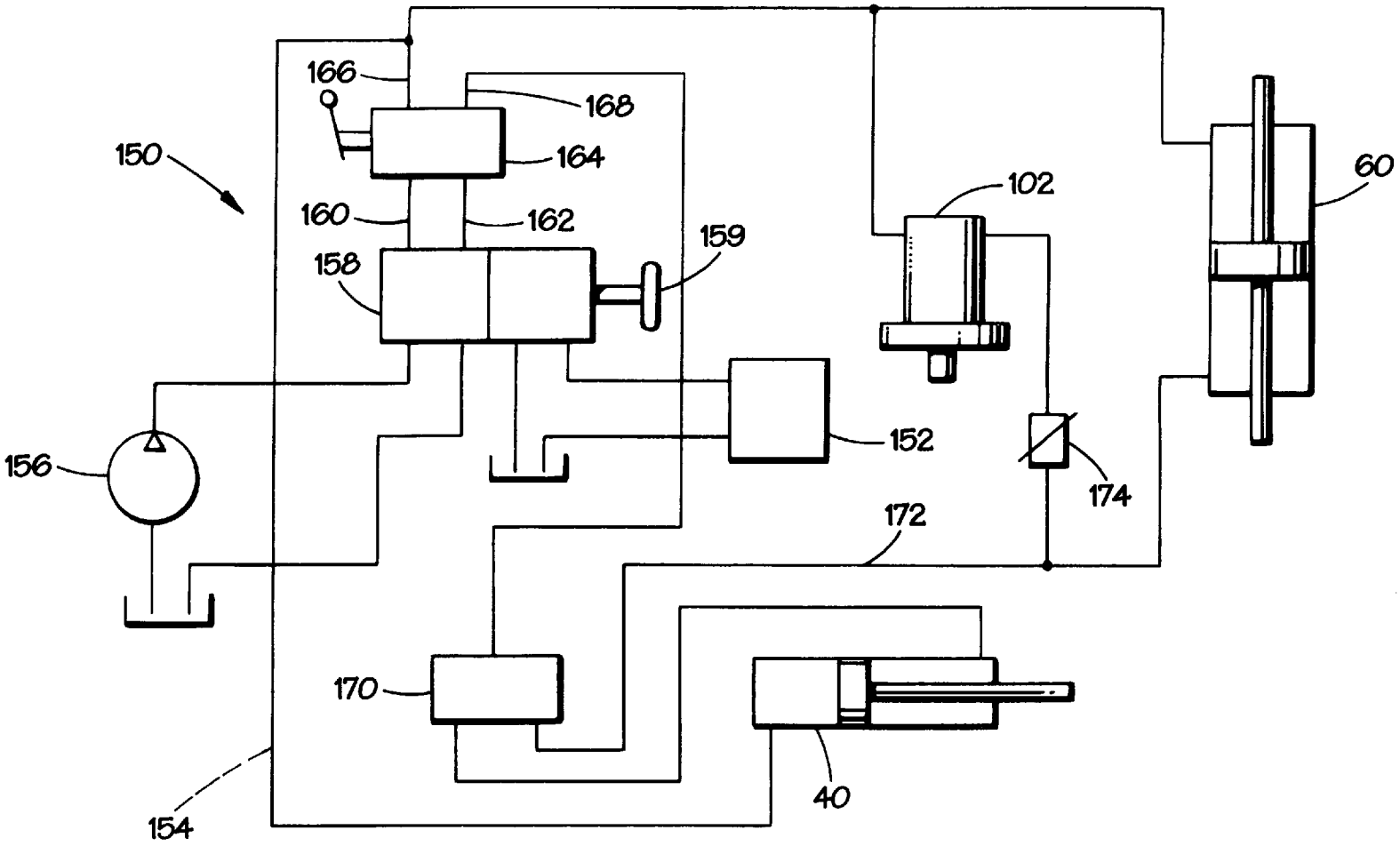
FIG. 2 is a schematic diagram of an embodiment of the hydraulic circuits for operating the primary drive and alignment assemblies.

Referring now to FIG. 2, the hydraulic circuit for the primary drive control 150 of the hydraulic cylinders 40, 60 and the hydraulic motor 102 are illustrated. The secondary drive control 152 is illustrated only in block diagram form, and a more detailed description of its operation and interaction with the circuitry shown in FIG. 2 is provided below in conjunction with the description of FIG. 3.

The hydraulic circuitry located onboard the apparatus 10 is shown enclosed within the dash line 154. External to the apparatus 10 is a conventional source of pressurized hydraulic fluid, such as would typically be available on a derrick where the apparatus 10 would likely be used. The conventional source of pressurized hydraulic fluid consists substantially of a pump 156 and associated conventional support hardware (not shown). The pump 156 is connected to the primary drive control 150 through conventional, flexible hydraulic lines, and, in particular, to one pair of inputs to a double diverter valve 158. The second pair of inputs to the double diverter valve 158 come from the secondary drive control 152.

The double diverter valve 158 includes a manually operable switch 159 that alternatively connects the pump 156 or the secondary drive control 152 to the outputs 160,162 of the double diverter valve 158. The outputs of the double diverter valve 160, 162 are, in turn, coupled to a two-way directional valve 164, which is normally biased to a neutral position, and operable in alternate directions to connect the lines 160, 162 to the outputs 166, 168 or alternatively, the outputs 168, 166. In this way, the direction of fluid flow through the lines 166, 168 may be reverse to provide reverse operation of the apparatus 10.

The output lines 166, 168 of the two-way directional valve 164 are connected to opposite sides of the hydraulic cylinder 40. The output line 166 is connected directly to one side of the hydraulic cylinder 40, while the output line 168 is connected to the opposite side of the hydraulic cylinder 40 through a single diverter valve 170. That is, in a first position, the single diverter valve 170 connects the output line 168 to the hydraulic cylinder 40; however, in a second operating position, the single diverter valve 170 connects the output line 168 to an output line 172 thereof. Thus, it should be appreciated that operation of the single diverter valve 170 controllably delivers pressurized fluid to either the hydraulic cylinder 40 or the output line 172.

The output line 172 of the single diverter valve 170 is connected to both the hydraulic motor 102 and to one side of the hydraulic cylinder 60. The opposite sides of the hydraulic cylinder 60 and the motor 102 are connected back to the output line 166 of the two-way diverter valve 164, thereby completing the hydraulic circuit.

An adjustable flow control valve 174 is also located between the output line 172 and the hydraulic motor 102. Manual adjustment of the adjustable hydraulic valve 174 ensures that while the motor 102 and hydraulic cylinder 60 are connected in parallel, the flow to the two devices may be adjusted relative to one another. Thus, manipulation of the adjustable control valve 174 permits a difference in flow rates between the hydraulic motor 102 and hydraulic cylinder 60, as needed, for example, to alter the rate of rotation of the safety valve 34 to correspond to the thread pitch located thereon.

A variable flow divider 190 is positioned intermediate the output line 172 and motor 102 and hydraulic cylinder 60. The variable flow divider 190 operates to maintain a relatively constant division of the available fluid flow to the motor 102 and hydraulic cylinder 60. In this way, one of the devices cannot "steal" all of the fluid flow and "starve" the other. That is, during certain conditions either the hydraulic cylinder 60 or motor 102 may be stressed severely and require the majority of fluid flow, thereby preventing proper operation of the other device. For example, when the safety valve 34 is positioned directly over the blow-out, fluid from the well is forced against the bottom of the safety valve 34 with considerable force. In order to move the safety valve 34 downward, this force must be overcome. Thus, most of the fluid flow from the pump 156 will be directed to the hydraulic cylinder 60, preventing the motor 102 from effectively rotating the safety valve. The variable flow divider 190 ensures that sufficient fluid flow is available to continue to rotate the motor 102 even in these extreme conditions.

Operation of the apparatus 10 under the control of the primary drive control 154 may now be described in conjunction with FIGS. 1 and 2. The operator initially stabs the apparatus 10 onto the well pipe 14, causing the clamp assembly 12 to automatically close about the threaded box end 16 and secure the apparatus 10 thereto.

Thereafter, the operator initiates the automatic mode by moving the control arm of the two-way directional valve 164 to the first operating position so that high pressure fluid is routed from the pump 156 to the double diverter valve 158 and through the two-way directional valve 164 onto the output line 168. As described more fully below, the single diverter valve 170 necessarily begins in the first operating position so that high pressure fluid is passed through it and to the hydraulic cylinder 40, and none is delivered to the hydraulic motor 102 and hydraulic cylinder 60. The high pressure fluid causes the hydraulic cylinder 40 to retract, moving the elevator 37 telescopically into the lower frame 36.

Once the hydraulic cylinder 40 has fully withdrawn the elevator 37 into the lower frame 36, the lower frame 36 engages a switch 180, which moves the single diverter valve 170 from its first operating position to the second operating position, thereby eliminating the delivery of high pressure fluid to the hydraulic cylinder 40, and instead delivering high pressure fluid to the output line 172 thereof.

The high pressure fluid in the line 172 causes the hydraulic cylinder 60 to begin to move upward, causing body 38 to correspondingly move downward, and carry the safety valve 34 toward the well pipe 14. At the same time, pressurized fluid in the line 172 is also delivered to the hydraulic motor 102, causing the motor 102 and safety valve 34 to begin rotating at a rate, owing to proper setting in the adjustable flow valve 174, corresponding to the thread pitch on the safety valve 34. The hydraulic cylinder 60 continues to pull the body 38 down and the motor 102 continues to rotate the safety valve 34 until such time as the operator releases the control arm on the two-way directional valve 164, ceasing the delivery of pressurized hydraulic fluid to both the motor 102 and hydraulic cylinder 60.

At this time, the safety valve 34 is properly installed in the well pipe 14, and the fluid flowing thereto may be terminated by proper actuation of the safety valve 34. The apparatus 10 may thereafter be returned to its original operating position by moving the control arm on the two-way directional valve 164 to the opposite direction, placing high pressure fluid on the output line 166, which will cause either the hydraulic cylinder 40 or the hydraulic motor 102 and hydraulic cylinder 60 to reverse operation, depending upon the position of the single diverter valve 170. The operator, of course, may manually select which of these operations is to occur by moving the switch 180 to force the single diverter valve into the desired position.

Additionally, the apparatus 10 may be removed from the safety valve 34 now that the safety valve 34 is properly installed in the well pipe 14, by first releasing the bracket 96 from the safety valve 34. Preferably, the lower support bracket 96 is split along its diameter and held together by a diametrically opposed hinge 182 and conventional latch (not shown). Thus, the operator releases the latch (not shown) and swings open the bracket 96 on its hinge 182. By now operating the control arm on the two-way directional valve 164 to the reverse direction, the movement of the hydraulic cylinder 60 causes the body 38 to raise the upper support bracket 96 off of the safety valve 34.

Once the safety valve has been fully released from the support brackets 94, 96, then the single diverter valve 170 can be manually switched to deliver pressurized fluid to the hydraulic cylinder 40 and extend the elevator 37. The latch assembly 12 is manually released to fully remove the apparatus 10 from the safety valve 34.

Figure 3:
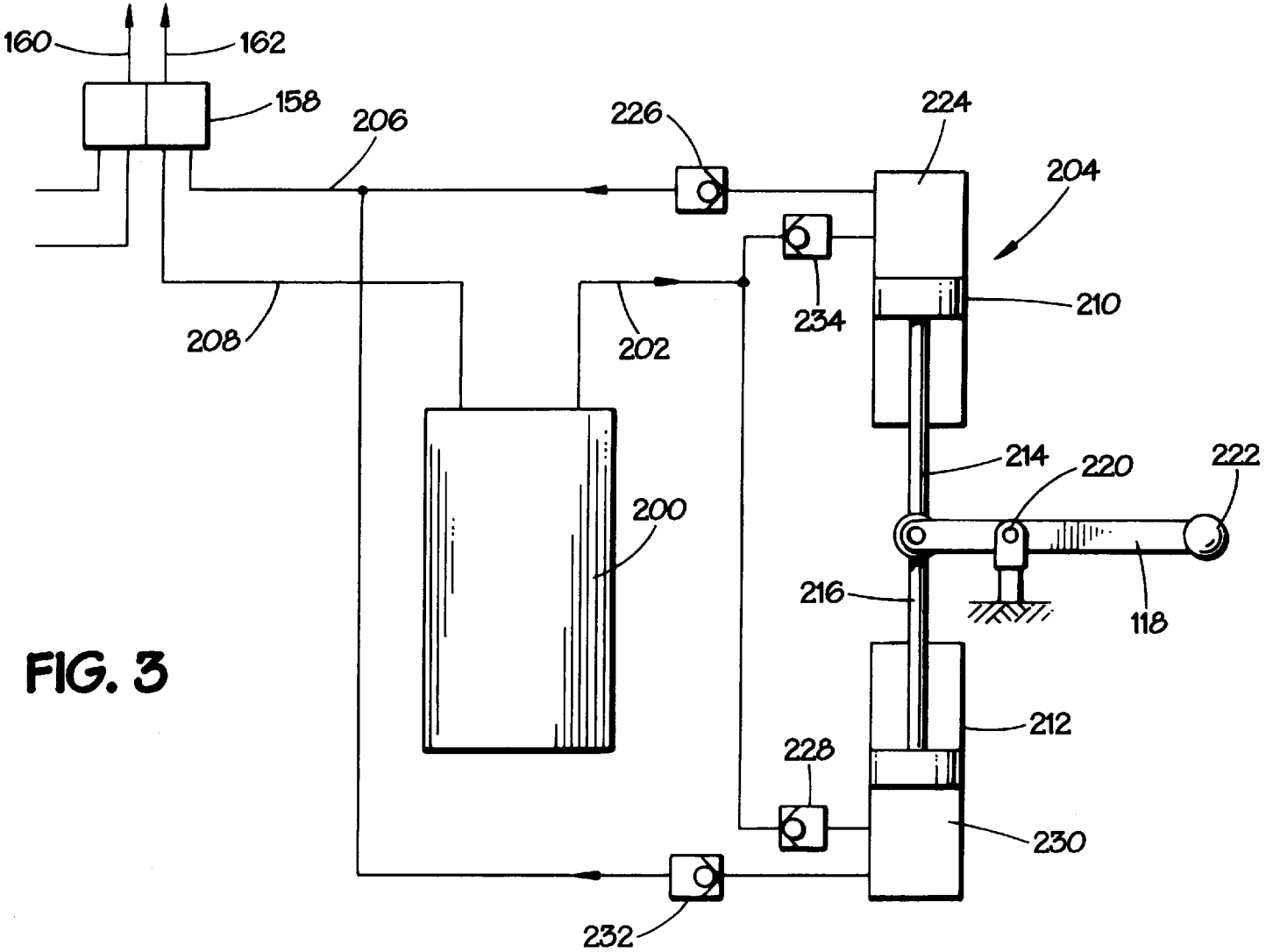
FIG. 3 is a schematic diagram of an embodiment of the hydraulic circuit and mechanical apparatus for operating the secondary drive and alignment assemblies.

Referring now to FIG. 3, a schematic diagram of an embodiment of the hydraulic circuit and mechanical apparatus for operating the secondary drive control 152 is shown. The secondary drive control 152 is intended to provide a manual mode of operation of the apparatus 10 in the event of a failure of the hydraulic pump 156 or its associated circuitry. Preferably, the secondary drive control 152 is entirely located within the apparatus 10, and allows the apparatus 10 to be relatively self-contained, so as to be operable entirely independent of its surroundings, such as, in the event of a failure of the pump 156 or power to the pump 156.

The secondary drive control 152 includes a source of hydraulic fluid, such as a conventional manual reserve tank 200. The tank 200 has an output line 202 connected to a dual-acting hydraulic pump 204. The pump 204, likewise, has an output line 206 connected to a first one of the second pair of inputs of the double diverter valve 158. An output line 208 of the tank 200 is connected as the second one of the second pair of inputs of the double diverter valve 158.

The dual-acting pump 204 includes a first and second hydraulic cylinder 210, 212 positioned opposite one another with their connecting rods 214, 216 coupled together, and to a manually operated lever 218. The lever 218 is connected to a pivot point 220 so that downward movement of the lever 220 at the actuating handle 222 produced upward movement of the connecting rods 214, 216. This upward movement compresses fluid in a chamber 224 within the hydraulic cylinder 210, forcing pressurized fluid onto the line 206 through a one-way valve 226. The upward movement also draws fluid from the tank 200 through the line 202 and a one-way valve 228 into a chamber 230 within the hydraulic cylinder 212.

Conversely, upward movement of the lever 218 produces a corresponding downward movement of the connecting rods 214, 216, pressurizing fluid within the chamber 230 and forcing it through a one-way valve 232 onto the line 206. The downward movement also draws fluid from the tank 200 through the line 202 and a one-way valve 234 into the chamber 224 within the hydraulic cylinder 210. In this manner, pressurized fluid is delivered to the double diverter valve 158 on each upward and each downward stroke of the lever 218.

Operation of the remaining hydraulic circuitry of FIG. 2 during the manual mode of operation is identical to that described above in conjunction with the description of the automatic mode of operation. It should be appreciated that the manual mode of operation is accomplished with a minimum amount of additional hardware over that used in the automatic mode of operation, due to the use of as much common hydraulic circuitry as possible. This use of common hydraulic circuitry substantially contributes to the compact size and lightweight nature of the apparatus 10.

It is envisioned that either a single-acting pump or a conventional, fixed displacement hydraulic motor could be substituted for the dual-acting pump 204 described herein without departing from the spirit and scope of the instant invention.

It should be appreciated that while the apparatus 10 is idle for extended periods of time, the weight of the body 38 and safety valve 34 may be sufficient to cause the body 38 to drift downward by forcing hydraulic fluid out of the hydraulic cylinder 60. This situation is eliminated by the construction of a constant pressure cylinder. That is, a pilot pressure line 300 is connected between the output line 302 of the hydraulic cylinder 60 and a controllable one-way valve 304. The one-way valve 304 is located in the input line 306 of the hydraulic cylinder 60. During normal operation, the one-way valve 304 prevents backward flow from the hydraulic cylinder 60 to the single diverter valve 170. However, when reverse operation is initiated, high pressure fluid is routed onto the output line 302 via the two-way directional valve 164. The high pressure on the output line 302 is communicated by the pilot line 300 to the controllable one-way valve 304, causing the one-way valve 304 to allow reverse fluid flow from the hydraulic cylinder 60 to the single diverter valve 170.

Although the above description describes details of a preferred embodiment of the present invention, it will be understood by those skilled in the art that numerous other embodiments and applications of the invention may exist or be developed. Although in many such applications, all of the advantages of the illustrated embodiment may not be achieved, certain desirable attributes may be attainable. The scope of the present invention should accordingly be limited only by the scope of the appended claims.

I claim:

1. An apparatus for threading a valve into a well pipe for shutting off upward flow therethrough, comprising:

means for attaching said apparatus to said well pipe;

means for moving said valve into general alignment with a longitudinal axis of said well pipe;

primary drive means for rotating and vertically displacing said valve, at least a portion of said primary drive means being located external to said apparatus;

secondary drive means for rotating and vertically displacing said valve, said secondary drive means being located onboard said apparatus;

means for selectively enabling the operation of one of said primary and secondary drive means.

2. An apparatus, as set forth in claim 1, wherein said means for attaching includes a clamp assembly adapted to latch about said well pipe in response to contact therewith.

3. An apparatus, as set forth in claim 1, wherein said means for moving said valve includes an elevator coupled to said means for attaching, a frame telescopically positioned about said elevator, and a hydraulic cylinder positioned within said frame and having a first end portion coupled to said frame and a second end portion coupled to said elevator, whereby movement of said hydraulic cylinder imparts telescopic movement of said elevator within said frame.

4. An apparatus, as set forth in claim 1, wherein said primary drive means includes:

an external source of pressurized hydraulic fluid having a high pressure and low pressure output;

a double diverter valve having a first pair of inputs hydraulically connected to the high and low pressure outputs of said external source of pressurized hydraulic fluid, said double diverter valve having a second pair of inputs hydraulically connected to the secondary drive means, said double diverter valve being operative to connect one of said first and second pairs of inputs to a pair of outputs;

a two way directional valve having a pair of inputs connected to the pair of outputs of said double diverter valve, said two way directional valve being operative to connect said pair of inputs to a pair of outputs in two opposite orientations, said first one of said pair of outputs being connected to a first port of a motor and a first and second hydraulic cylinder; and a single diverter valve having one input connected to a second one of the pair of outputs of the two way directional valves, said single diverter valve having a first output connected to a second port of the first hydraulic cylinder and a second output connected to a second port of the second hydraulic cylinder and the hydraulic motor, said single diverter valve being operative to couple said input to one of said first and second outputs and being adapted to switch from connecting said input to said first output to connecting said input to said second output in response to movement of said first hydraulic cylinder to a first preselected location.

5. An apparatus, as set forth in claim 4, wherein said secondary drive means includes a manually operable hydraulic pump having a high pressure and low pressure output connected to the second pair of inputs of said double diverter valve.

6. An apparatus, as set forth in claim 5, wherein said manually operable hydraulic pump includes:

a tank adapted for storing hydraulic fluid, and having first and second outputs, said second output being connected to a first one of the second pair of inputs of said double diverter valve;

at least one hydraulic cylinder having a connecting rod adapted for movement into said hydraulic cylinder to pressurize fluid in a chamber located therein, said chamber having a first input connected through a one-way valve to said first tank output, a second input connected through a one-way valve to a second one of the second pair of inputs of said double diverter valve; and a manually operable lever connected to said hydraulic cylinder connecting rod and adapted for moving said connecting rod into and out of said hydraulic cylinder in response to movement thereof.

7. An apparatus, as set forth in claim 4, wherein said means for selectively enabling includes a manually operable switch connected to said double diverter valve and being adapted for moving said double diverter valve between first and second operating positions, said first pair of inputs being connected to said pair of outputs in said first operating position, and said second pair of inputs being connected to said pair of outputs in said second operating position.

8. An apparatus, as set forth in claim 1, wherein said primary drive means has forward and reverse modes of operation, and including means for detecting said primary drive means being in said forward mode of operation and preventing reverse operation in response thereto.

9. An apparatus for threading a valve into a well pipe for shutting off upward flow therethrough, comprising:

means for attaching said apparatus to said well pipe;

means for moving said valve into general alignment with a longitudinal axis of said well pipe;

primary drive means for rotating and vertically displacing said valve, said primary drive means having forward and reverse modes of operation; and means for detecting said primary drive means being in said forward mode of operation and preventing reverse operation in response thereto.

10. An apparatus, as set forth in claim 9, wherein said means for attaching includes a clamp assembly adapted to latch about said well pipe in response to contact therewith.

11. An apparatus, as set forth in claim 9, wherein said means for moving said valve includes an elevator coupled to said means for attaching, a frame telescopically positioned about said elevator, and a hydraulic cylinder positioned within said frame and having a first end portion coupled to said frame and a second end portion coupled to said elevator, whereby movement of said hydraulic cylinder imparts telescopic movement of said elevator within said frame.

12. An apparatus, as set forth in claim 9, herein said primary drive means includes:

an external source of pressurized hydraulic fluid having a high pressure and low pressure output;

a double diverter valve having a first pair of inputs hydraulically connected to the high and low pressure outputs of said external source of pressurized hydraulic fluid, said double diverter valve having a second pair of inputs hydraulically connected to the secondary drive means, said double diverter valve being operative to connect one of said first and second pairs of inputs to a pair of outputs;

a two way directional valve having a pair of inputs connected to the pair of outputs of said double diverter valve, said two way directional valve being operative to connect said pair of inputs to a pair of outputs in two opposite orientations, said first one of said pair of outputs being connected to a first port of a motor and a first and second hydraulic cylinder; and a single diverter valve having one input connected to a second one of the pair of outputs of the two way directional valves, said single diverter valve having a first output connected to a second port of the first hydraulic cylinder and a second output connected to a second port of the second hydraulic cylinder and the hydraulic motor, said single diverter valve being operative to couple said input to one of said first and second outputs and being adapted to switch from connecting said input to said first output to connecting said input to said second output in response to movement of said first hydraulic cylinder to a first preselected location.

13. An apparatus, as set forth in claim 9, wherein at least a portion of said primary drive means is located external to said apparatus, and including:

secondary drive means for rotating and vertically displacing said valve, said secondary drive means being located onboard said apparatus;

means for selectively enabling the operation of one of said primary and secondary drive means.

14. An apparatus, as set forth in claim 13, herein said secondary means includes a manually operable hydraulic pump having a high pressure and low pressure output connected to the second pair of inputs of said double diverter valve.

15. An apparatus, as set forth in claim 14, wherein said manually operable hydraulic pump includes:

a tank adapted for storing hydraulic fluid, and having first and second outputs, said second output being connected to a first one of the second pair of inputs of said double diverter valve;

at least one hydraulic cylinder having a connecting rod adapted for movement into said hydraulic cylinder to pressurize fluid in a chamber located therein, said chamber having a first input connected through a one-way valve to said first tank output, a second input connected through a one-way valve to a second one of the second pair of inputs of said double diverter valve; and a manually operable lever connected to said hydraulic cylinder connecting rod and adapted for moving said connecting rod into and out of said hydraulic cylinder in response to movement thereof.

16. An apparatus, as set forth in claim 13, wherein said means for selectively enabling includes a manually operable switch connected to said double diverter valve and being adapted for moving said double diverter valve between first and second operating positions, said first pair of inputs being connected to said pair of outputs in said first operating position, and said second pair of inputs being connected to said pair of outputs in said second operating position.

17. An apparatus for threading a valve into a well pipe for shutting off upward flow therethrough, comprising:

means for attaching said apparatus to said well pipe, said means for attaching including a clamp assembly adapted to latch about said well pipe in response to contact therewith;

means for moving said valve into general alignment with a longitudinal axis of said well pipe, said means for moving said valve includes an elevator coupled to said means for attaching, a frame telescopically positioned about said elevator, and a hydraulic cylinder positioned within said frame and having a first end portion coupled to said frame and a second end portion coupled to said elevator, whereby movement of said hydraulic cylinder imparts telescopic movement of said elevator within said frame;

primary drive means for rotating and vertically displacing said valve, said primary drive means includes:

an external source of pressurized hydraulic fluid having a high pressure and low pressure output;

a double diverter valve having a first pair of inputs hydraulically connected to the high and low pressure outputs of said external source of pressurized hydraulic fluid, said double diverter valve having a second pair of inputs hydraulically connected to the secondary drive means, said double diverter valve being operative to connect one of said first and second pairs of inputs to a pair of outputs;

a two way directional valve having a pair of inputs connected to the pair of outputs of said double diverter valve, said two way directional valve being operative to connect said pair of inputs to a pair of outputs in two opposite orientations, said first one of said pair of outputs being connected to a first port of a motor and a first and second hydraulic cylinder; and a single diverter valve having one input connected to a second one of the pair of outputs of the two way directional valves, said single diverter valve having a first output connected to a second port of the first hydraulic cylinder and a second output connected to a second port of the second hydraulic cylinder and the hydraulic motor, said single diverter valve being operative to couple said input to one of said first and second outputs and being adapted to switch from connecting said input to said first output to connecting said input to said second output in response to movement of said first hydraulic cylinder to a first preselected location;

secondary drive means for rotating and vertically displacing said valve, said secondary drive means being located onboard said apparatus, said secondary drive means including a manually operable hydraulic pump having a high pressure and low pressure output connected to the second pair of inputs of said double diverter valve; and means for selectively enabling the operation of one of said primary and secondary drive means.

18. An apparatus, as set forth in claim 17, wherein said manually operable hydraulic pump includes:

a tank adapted for storing hydraulic fluid, and having first and second outputs, said second output being connected to a first one of the second pair of inputs of said double diverter valve;

at least one hydraulic cylinder having a connecting rod adapted for movement into said hydraulic cylinder to pressurize fluid in a chamber located therein, said chamber having a first input connected through a one-way valve to said first tank output, a second input connected through a one-way valve to a second one of the second pair of inputs of said double diverter valve; and a manually operable lever connected to said hydraulic cylinder connecting rod and adapted for moving said connecting rod into and out of said hydraulic cylinder in response to movement thereof.

19. An apparatus, as set forth in claim 17, wherein said means for selectively enabling includes a manually operable switch connected to said double diverter valve and being adapted for moving said double diverter valve between first and second operating positions, said first pair of inputs being connected to said pair of outputs in said first operating position, and said second pair of inputs being connected to said pair of outputs in said second operating position.

20. An apparatus, as set forth in claim 17, wherein said primary drive means has forward and reverse modes of operation, and including means for detecting said primary drive means being in said forward mode of operation and preventing reverse operation in response thereto.

* * * * *

UNITED STATES PATENT AND TRADEMARK OFFICE

CERTIFICATE OF CORRECTION

| | | |
|---|---|---|
| PATENT NO. | : | 5,806,589 |
| DATED | : | September 15, 1998 |
| INVENTOR(S) | : | Duane Lang |

It is certified that error appears in the above-identified patent and that said Letters Patent is hereby corrected as shown below:

Claim 12, column 10, line 7, delete "herein" and insert --wherein-- therefor.

Claim 14, column 10, line 46, delete "herein" and insert --wherein-- therefor.

Signed and Sealed this

Twenty-ninth Day of December, 1998

*Attest:*

Bruce Lehman

BRUCE LEHMAN

*Attesting Officer*

*Commissioner of Patents and Trademarks*